US006832841B2

(12) United States Patent
Kitakata

(10) Patent No.: US 6,832,841 B2
(45) Date of Patent: Dec. 21, 2004

(54) SEWING MACHINE WITH ILLUMINATING LED LAMP

(75) Inventor: Takeshi Kitakata, Chiryu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/373,806

(22) Filed: Feb. 27, 2003

(65) Prior Publication Data

US 2003/0184994 A1 Oct. 2, 2003

(30) Foreign Application Priority Data

Mar. 28, 2002 (JP) ..... 2002-091555

(51) Int. Cl.[7] ..... D05B 79/00

(52) U.S. Cl. ..... 362/90; 362/256; 362/311; 362/800; 257/98; 112/278

(58) Field of Search ..... 362/90, 186, 256, 362/311, 363, 377, 800; 257/98–100; 112/278

(56) References Cited

U.S. PATENT DOCUMENTS 4,763,589 A * 8/1988 Laidig et al. ..... 112/278
5,896,093 A * 4/1999 Sjobom ..... 362/800
6,168,284 B1 * 1/2001 Wacker et al. ..... 362/90
6,345,903 B1 * 2/2002 Koike et al. ..... 362/800

FOREIGN PATENT DOCUMENTS

JP 2002-191886 7/2002

* cited by examiner

*Primary Examiner*—Stephen F Husar
(74) *Attorney, Agent, or Firm*—Oliff & Berridge, PLC

(57) ABSTRACT

A sewing machine includes a sewing bed on which cloth to be sewn is placed, a pillar extending upward from the bed, a sewing arm extending horizontally from the pillar so as to be located over the bed, a high brightness LED lamp including a lens, a lamp cover provided to cover and support the LED lamp and made from a material which can transmit light emitted by the LED lamp, and a supporting member provided on the arm for supporting the lamp cover further supporting the LED lamp.

14 Claims, 4 Drawing Sheets

SEWING MACHINE WITH ILLUMINATING LED LAMP

BACKGROUND OF THE INVENTION

1. Field of the Invention

This invention relates to a sewing machine provided with a high brightness InGaN (indium-gallium-nitride) LED lamp for illuminating a sewing bed on which cloth to be sewn is placed.

2. Description of Related Art

There have conventionally been provided sewing machines comprising a sewing bed on which cloth to be sewn is placed, a pillar extending upward from the bed, and a sewing arm extending horizontally from an upper end of the pillar so as to be located over the bed. The arm is provided with an electric lamp for illuminating the bed from above. The lamp comprises a generally cylindrical glass tube and a filament disposed in the tube. The tube is filled with an inert gas etc. and hermetically sealed (electric lamp of sealed tube type).

In sewing, the user firstly places a piece of cloth on the bed. A sewing operation is carried out while the cloth is slid with the user's hand in touch with it. In this case, the sewing can be performed while the bed on which the cloth is placed is illuminated by the aforesaid lamp. Furthermore, the user folds the cloth with his or her hand when sewing is started and finished. Thus, the user is sometimes charged with static electricity when the cloth is slid or folded.

The glass tube in which the filament and inert gas are accommodated has a diameter of 15 mm in the above-mentioned conventional illuminating device comprising the sealed-tube type lamp. A socket to which the lamp is mounted has a diameter of 20 mm, and the lamp has a length of 40 mm when mounted to the socket. As a result, the lamp increases the size of the illuminating device.

The inventor had a conception of the following illuminating device for the purpose of reducing the size thereof. The contemplated illuminating device included a diode converting electric current to light or LED lamp. The LED lamp necessitates no large space for an inert gas and filament which was required in the conventional lamp of the sealed-tube type, thereby reducing the size of a light source. The illuminating device can be reduced in the size and weight since the LED lamp has a diameter of 5 mm and length of 7.5 mm. Furthermore, use of the LED lamp can improve the service life of the illuminating device (maintenance-free for one hundred thousand hours) and prevent heating of the illuminating device. The service life of the LED lamp is restricted by a material of a lens provided in the lamp although the service life of an LED chip is almost infinite. In this case, the service life of the LED lamp can further be improved when a silicon resin is used as the material of the lens instead of an epoxy resin. When made from an epoxy resin, the lens is blurred by ultraviolet absorption such that a luminous efficiency of the LED lamp is reduced as compared with a silicon resin.

Elements of compound semiconductor used for the LED lamp include those of group III (B, Al, Ga, In, Tl) and those of group V (N, P, As, Sb, Bi) of the periodic table. III-V compound semiconductors used for the LED lamps include those of the high brightness type or high intensity type which are made from InGaN (indium-gallium-nitride) and emit blue light, those of other ternary alloys (AlGaP, AlGaAs, etc.) or those of quaternary alloys (AlGaInP). Electric energy is directly converted to light in these LED lamps using compound semiconductors of direct transition type. Accordingly, an amount of heat generated in these LED lamps is smaller than the aforesaid illuminating device using the tube-sealed electric lamp. However, since an LED lamp uses the p-n junction for light emission, it has a low breakdown voltage (not more than 1 kV) with respect to static electricity irrespective of voltage application or no-voltage. Consequently, an LED lamp is easy to be broken down by discharge from arms or hands of a person charged with static electricity depending on environment in which the LED lamp is disposed.

The user of the sewing machine is easy to be charged with static electricity generated as the result of contact of his or her hand or arm with the cloth. Accordingly, electric discharge due to the static electricity occurs such that electric current flows from the arm or hand of the user to the LED lamp, whereupon there is a possibility that the LED lamp may be broken. Thus, the LED lamp involves problems to be solved before it is employed as an illuminating device provided in the sewing machine. Therefore, the electric lamps of the sealed tube type have generally been used as the illuminating device provided in the sewing machine. Accordingly, a larger electric lamp than the LED lamp is generally used, and the sewing machine is increased in size since the LED lamp needs to be accommodated in the illuminating device. Furthermore, a peculiar noise caused by an inverter has also been a matter of concern in an illuminating device comprising a cold cathode fluorescence lamp.

SUMMARY OF THE INVENTION

Therefore, an object of the present invention is to provide a sewing machine in which the illuminating device accommodated in the sewing arm can be reduced in size without use of the electric lamps and which can be protected against static electricity.

The present invention provides a sewing machine comprising a sewing bed on which cloth to be sewn is placed, a pillar extending upward from the bed, a sewing arm extending horizontally from the pillar so as to be located over the bed, a high brightness LED lamp including a lens, a lamp cover provided to cover and support the LED lamp and made from a material which can transmit light emitted by the LED lamp, and a supporting member provided on the arm for supporting the lamp cover further supporting the LED lamp.

In the above-described sewing machine, the LED lamp is covered by the lamp cover and mounted on the supporting member provided on the arm. Consequently, the LED lamp can be prevented from being broken due to discharge from the user etc. charged with static electricity.

In a preferred form, the lamp cover diffuses the light emitted by the LED lamp in a plurality of directions intersecting each other. Furthermore, the lamp cover preferably has a surface including at least a part serving for light diffusion, said part being formed with an engraving which diffuses the light emitted by the LED lamp.

BRIEF DESCRIPTION OF THE DRAWINGS

Other objects, features and advantages of the present invention will become clear upon reviewing the following description of an embodiment, made with reference to the accompanying drawings, in which.

DETAILED DESCRIPTION OF THE INVENTION

Figure 1A:
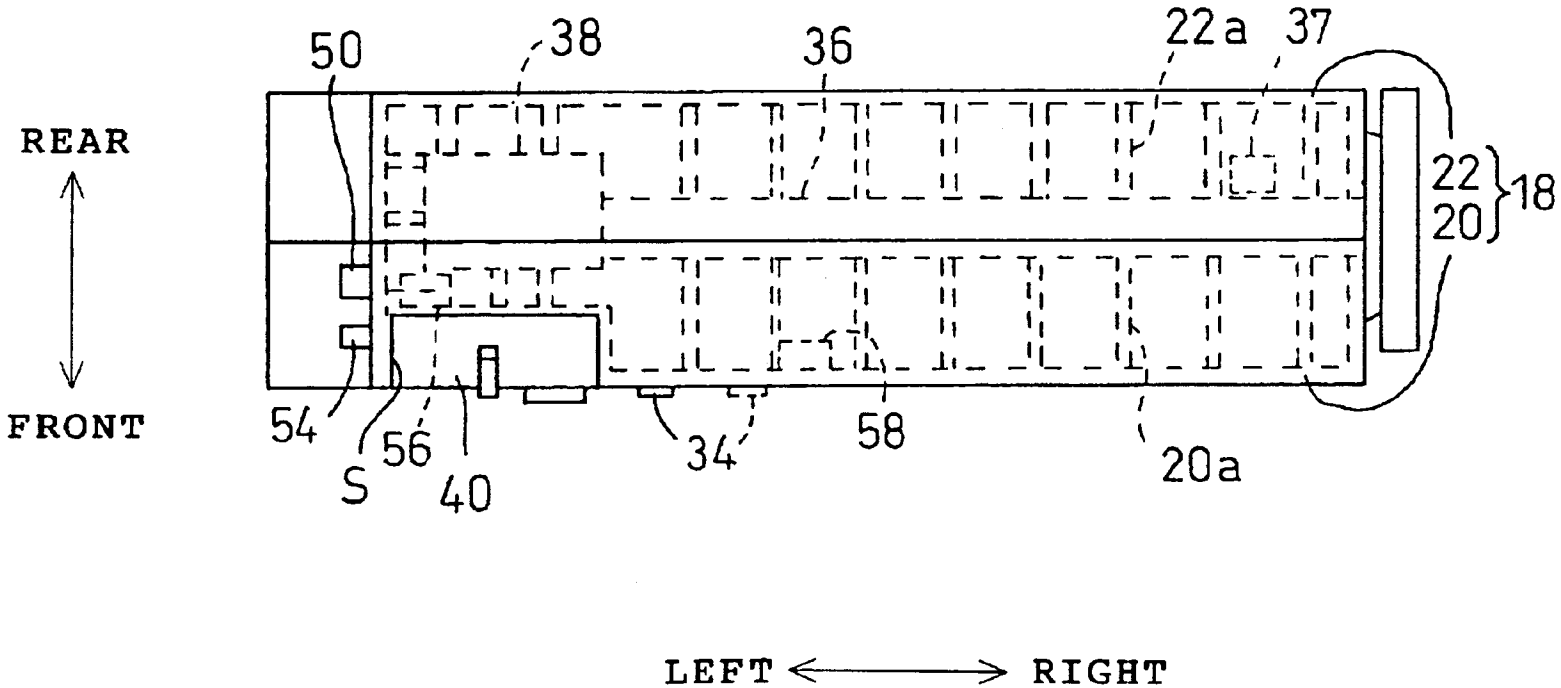
FIGS. 1A and 1B are a top plan view of a sewing machine in accordance with one embodiment of the present invention and a front view of the sewing machine as viewed at the user's side, respectively.
Figure 1B:
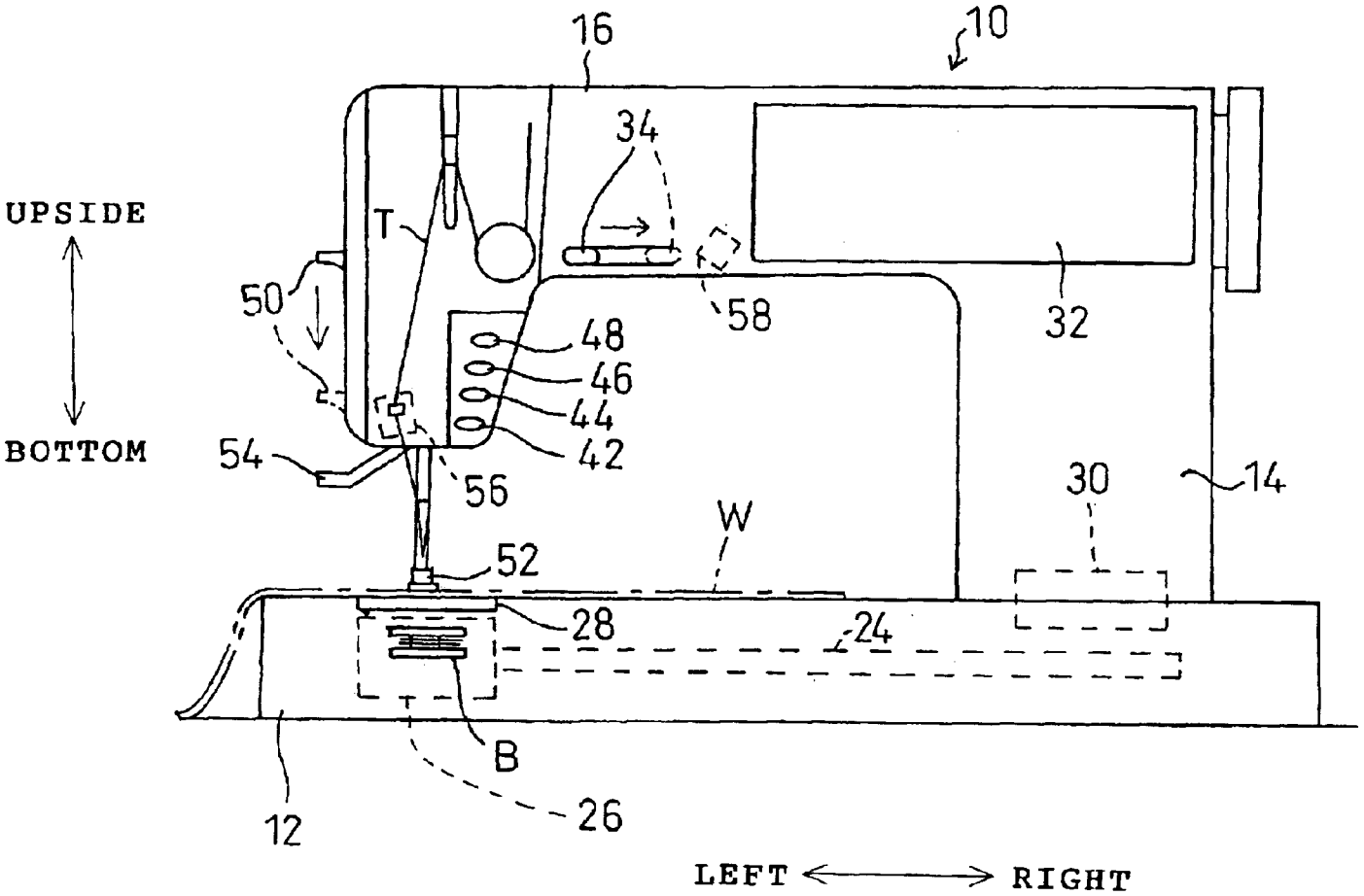

One embodiment of the invention will be described in detail with reference to the accompanying drawings. Referring to FIGS. 1A and 1B, a sewing machine 10 in accordance with the invention comprises a sewing bed 12 having a horizontal plane, a pillar 14 extending upward from a right-hand portion of the bed 12 and a sewing arm 16 extending horizontally rightward from the pillar 14 so as to be opposed to the bed 12 or located over the bed. The bed 12, pillar 14 and arm 16 are formed continuously into a resin frame 18 including a front frame 20 and a rear frame 22. Japanese Patent Application No. 2001-295564 filed by the assignee of the present application discloses such a frame as described above.

A lower shaft 24 made from a metal is supported on the rear frame 22 so as to extend lengthwise inside the bed 12 as viewed in FIG. 1B. A lower mechanism 26 is mounted on the rear frame 22 at a left-hand end of the shaft 24. The lower mechanism 26 comprises a thread loop capturing mechanism including one or more metal components, a feed dog mechanism, thread cutting mechanism, etc. A throat plate 28 is mounted on a portion of the frame 18 located over the thread loop capturing mechanism as shown in FIG. 1B. A machine motor 30 serving as a drive source for the lower shaft 24 etc. is provided in a boundary between the bed 12 and pillar 14.

A transparent touch panel 32 with a liquid crystal display or LCD is provided over both the pillar 14 and the arm 16 so that a desired embroidery pattern is selected thereon. A slidable operating member 34 is provided on a front face of the arm 16 so as to be located on the left of the touch panel 32, as viewed in FIG. 1B. The operating member 34 is operated to set a rotational speed of the motor 30. When the operating member 34 is slid to assume a position shown by broken line in FIG. 1B, the motor 30 is rotated at high speeds.

A main shaft 36 made of a metal is mounted on the rear frame 22 in the arm 16. The main shaft 36 extends lengthwise inside the arm 16 as viewed in FIG. 1A. An upper mechanism 38 is supported on the rear frame 22 at a left-hand end of the main shaft 36. The upper mechanism 38 includes a needle bar driving mechanism, presser foot mechanism and threading mechanism. The lower shaft 24, lower mechanism 26, main shaft 36, upper mechanism 38, etc. are disposed substantially into a C-shape and supported on the resin frame 18 having a thermal expansion coefficient differing from those of metals.

An attachment portion S is formed in a left-hand end front of the arm 16. The attachment portion S extends vertically and is recessed rearward. A thread cassette 40 serving as a needle thread source is attached to the attachment portion S. The attachment portion S is recessed rearward or inside the sewing machine 10 in order that a sufficient visual range may be ensured for a distal end of the needle by reducing projecting portions. See, for example, Japanese Patent Application No. 2000-398266 filed by the assignee of the present application and disclosing such a sewing machine provided with a thread cassette detachably attached thereto.

The front face of the arm 16 includes a portion below a bent portion of the thread cassette 40, in which portion are provided a start/stop or S/S button 42 for starting and stopping the motor 30, a reverse stitching button 44 or backtacking button, a needle position switching button 46 for switching the needle between upper and lower stop positions, and thread cutting button 48 for cutting thread. A threading lever 50 is provided on a left side of the arm 16 for threading a needle. When the lever 50 is moved downward as shown by one-dot chain line in FIG. 1B, the threading mechanism threads a needle. In this case, the user's hand is positioned below the arm 16 when the lever 50 is moved to the lower position shown by one-dot chain line. A presser foot operating lever 54 is provided on the lower portion of the arm 16 for moving a presser foot 52 upward or downward. Accordingly, operations regarding the sewing are carried out at a front side of the sewing machine 10.

Figure 2B:
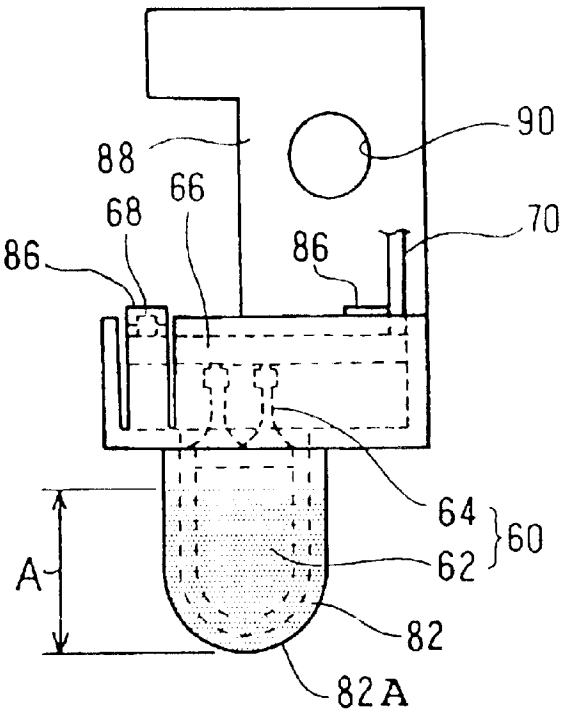
FIGS. 2A and 2B are a left side view of an illuminating device mounted on a supporting member and a front view of the illuminating device as viewed from the user's side, respectively.
Figure 2A:
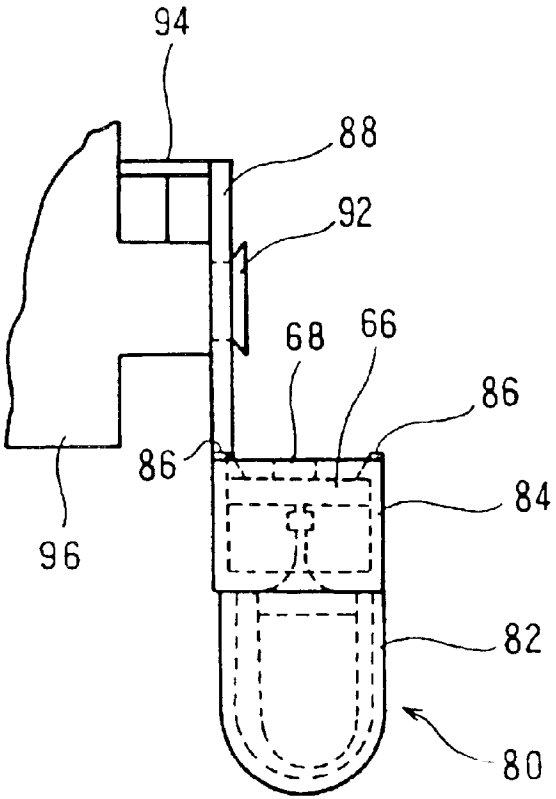
Figure 3:
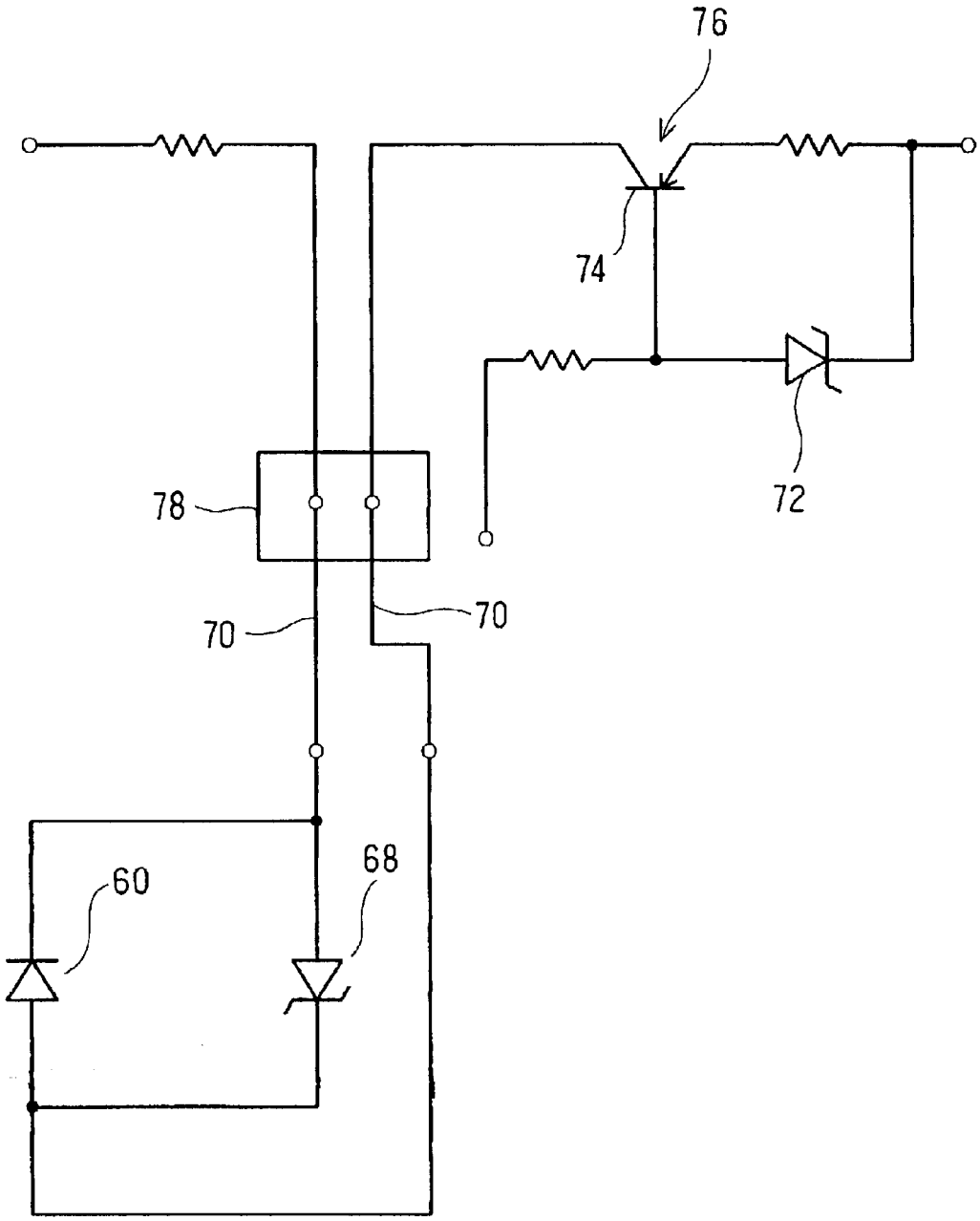
FIG. 3 is a schematic circuit diagram of the illuminating device.

The arm 16 includes an underside formed with two, right-hand and left-hand, openings in which illuminating devices 56 and 58 are provided respectively, as viewed in FIG. 1B. The bed 12 or cloth W placed thereon is illuminated by the two lamps 56 and 58. As a result, the bed 12 can be prevented from being hidden behind the user's hand or arm. Each of the illuminating devices 56 and 58 includes a high brightness LED lamp 60 made from a III–V compound semiconductor material such as GaN (gallium-nitride), InGaN (indium-gallium-nitride), other ternary alloys (AlGaP, AlGaAs, etc.) or quaternary alloys (AlGaInP). Each LED lamp 60 includes an achromatic lens 62 spaced from an LED chip with a slight gap (0.35 mm) therebetween. The lens 62 transmits light therethrough and is made from an epoxy resin or silicon resin. The lens 62 has a diameter of 5 mm and a length of 7.5 mm. Two leads 64 extend from the lens 62 as shown in FIGS. 2A and 2B. An assembly including the LED lamp 60, lens 62 and leads 64 has a length of about 16 mm. The leads 64 are connected to a substrate 66. A Zener diode 68, harness 70 and the like are provided on the substrate 66. The harness 70 is connected via a connector 78 to an illuminating constant current circuit 76 including a Zener diode 72 provided at the sewing machine side and a transistor 74. See FIG. 3. The substrate 66 is, for example, 7 mm long and 13 mm broad and has a thickness of about 1 mm.

The aforesaid LED lamp 60 has a quantity of light ranging from about 1.5 to 6.0 cd and is smaller in size than a conventional illuminating electric lamp emitting the same quantity of light as the LED lamp 60 and having a diameter of 15 mm, a length of 20 mm and further having a length of 40 mm when it includes a socket. Consequently, since a region for accommodating each of the illuminating devices 56 and 58 is rendered smaller, the size of the arm 16 can be reduced. Further, the LED lamp 60 has smaller electric power consumption than a conventional illuminating electric lamp emitting the same quantity of light as the LED lamp 60 and ranging from 1.0 to 5.0 W. Additionally, when the current flowing through the LED lamp 60 has a normal value, the temperature of the LED lamp is also normal or within a rated value. Even if the current is increased by 15 to 20%, the temperature is only increased into a range of 35 to 40° C. The temperature of a conventional illumination lamp emitting the same quantity of light as the LED lamp 60 ranges from 50 to 80° C. Accordingly, the temperature of the LED lamp 60 is not almost increased as compared with the conventional illumination lamp, whereupon the user feels no heat.

An insulating cover 80 is made from an acrylic or polymethylmethacrylate (PMMA) resin and covers the LED lamp 60 and substrate 66 so that the LED lamp 60 is prevented from being subjected to electric discharge due to static electricity produced by the user's hand. Since the insulating cover 80 is made from the acrylic resin, it has a total light transmittance ranging from 90 to 93%. The insulating cover 80 includes a lens covering portion 82 opposed to the lens 62 of the LED lamp 60. The lens covering portion 82 has a thickness of about 0.8 mm, which value is sufficiently larger than a value of 100 $\mu$m required for a measure against static electricity. The lens covering portion 82 of the cover 80 covers the entire lens 62 with a gap of about 0.8 mm therebetween. The lens covering portion 82 has a curvature determined so that a substantially constant space is defined between the lens covering portion 82 and the lens 62 without change in a curvature of the lens. The curvature of the lens covering portion 82 is determined with due regard to directivity of the LED lamp 60. When the lamp 60 and cover 80 are disposed so that the respective centers of distal substantially semi-spherical portions of the lamp 60 and cover 80 agree with each other, the lamp 60 and cover 80 can easily be designed so that a location of illumination of the LED lamp 60 is adjustable so as to take a desired position or angle. More specifically, when the centers do not agree with each other, a light path defined by each component needs to be taken into account. Accordingly, since adjustment of the location of illumination and angle of the LED lamp becomes difficult, a designing work for the lens 62 and cover 82 is complicated. However, the above-described construction can overcome the problem.

The substrate 66 to which the LED lamp 60 is attached is mounted on a substrate mounting portion 84 of the insulating cover 80 by an elastic claw 86, whereby four corners of the substrate 66 and the mounted side of the lamp 60 are covered with the insulating cover 80. In other words, the insulating cover 80 supports the substrate 66 further supporting the LED lamp 60.

A rough engraving is formed on at least a portion of an outer surface 82A of the lens cover 82 by blasting, as shown in FIG. 2B. The engraving extends upward from the lower end of the lens 62, covering about 90 percent of the lens cover 82 (a range shown by A in FIG. 2B), as viewed in FIG. 2B. Thus, the engraving is formed on the outer face 82A of the insulating cover 80 and a mirror surface is provided inside the cover so as to confront the LED lamp 60. Accordingly, when a prism is supposed to be provided between the engraving and the mirror surface, light can efficiently be spread outside a range of directivity or area of concentration. More specifically, since light emitted by the LED lamp is diffused in a plurality of directions intersecting each other, a light ring due to light directivity peculiar to the LED lamp 60 can be prevented from occurring on the bed 12 or cloth W or at least can be reduced. The aforesaid engraving may be formed so as to cover a spherical surface of the lens 62 used for illumination in view of the working efficiency in the die cutting etc. during engraving. Thus, a range of engraving can be set as occasion demands.

The substrate mounting portion 84 includes a plate-shaped assembling portion 88 extending in the direction opposite to the lens cover 82. The assembling portion 88 is formed with a central through hole 90. A metal screw 92 is inserted through the hole 90 so that the insulating cover 80 is fixed to a resin supporting member 96, which is further fixed inside the arm 16. The cover 80 is formed with a locking portion 94 projecting in the direction perpendicular to the assembling portion 88. The locking portion 94 prevents rotation of the cover 80 when the cover is mounted to the arm 16. The lens cover 82, substrate mounting portion 84, claws 86, assembling portion 88 and locking portion 94 are formed integrally with the cover 80, whereupon the LED lamp 60 can easily be assembled to the arm 16 and an error caused during assembling can be reduced. Thus, the arm 16 supports the substrate 66 and cover 80 both of which further support the LED lamp 60.

In sewing by the sewing machine, the user turns on the illuminating devices 56 and 58 so that the cloth W placed on the bed 12 is lighted up. The user then slides the cloth W on the bed 12 with his or her hand put on the cloth. Thus, the user sometimes charges with static electricity since the user folds and slides the cloth W during sewing. Furthermore, the user's fingers or hand is sometimes located close to the illuminating devices 56 and 58. For example, the user's fingers or hand is located at the lower left-hand end of the arm 16 when the user depresses the S/S button 42 or the like, as viewed in FIG. 1B. In this case, the user's fingers or hand comes close to the LED lamp 60 of the right-hand illuminating device 56. The situation also occurs when another operating button or lever is operated.

Furthermore, the foregoing situation also occurs when the sewing machine 10 is moved with the user's hand being applied to the left-hand face of the arm 16 or when a needle thread T is set in a thread handling area or a bobbin B (see FIG. 1B) of bobbin thread is attached. When the operating member 34 is slid to the position shown by broken line, the user's fingers or hand is located at a horizontally central portion of the arm 16. In this condition, the user's fingers or hand comes close to the LED lamp 60 of the right-hand illuminating device 58. The same situation also occurs when a left-hand part of the touch panel 32 is operated. Additionally, the same situation further occurs when the user's hand is put into a bosom between the underside of the arm 16 and the bed 12 to be applied to the underside of the arm so that the sewing machine 10 is transferred or otherwise moved. In each of the above-described cases, the user's fingers come close to the LED lamp 60 of either illuminating device 56 or 58. However, since the LED lamp 60 of each illuminating device is covered with the insulating cover 80, the electric discharge is prevented between the fingers and the LED lamp 60.

Each LED lamp 60 employed in the sewing machine of the embodiment emits white light. The emitted white light may be a pseudo-white light (blue-yellow LED chip), a white light by ultraviolet source, a white light by red-green-blue source or a fluorescent white light by blue-violet source. A clear light ring due to directivity is produced in these LED lamps. However, a degree of light diffusion can be increased when the depth of the engraving is increased or the engraving is rendered fine or maintained in the rough state. Consequently, the light ring can be extinguished or reduced. Furthermore, the wavelength can be changed when a pigment is used in the lens so that the white color is mixed with another color. Consequently, the luminosity can be adjusted. Additionally, the LED lamp 60 may emit a colored light other than the white color. However, the white light is desirable for the purpose of grasping or acknowledging the colors of the cloth W and thread.

The invention should not be limited to the embodiment described above with reference to the drawings but can be modified or expanded as follows. The insulating cover 80 is made from the PMMA resin in the foregoing embodiment. However, there is a possibility that an abnormal current may increase the temperature of the LED lamp 60. In view of such a temperature increase for some reason, the insulating cover may be made from a polycarbonate or PC resin which can withstand deformation or expansion due to a temperature increase, instead. Furthermore, the insulating cover may be made from a cycloolefin resin having a high total light transmittance, low water absorption and low specific gravity characteristic.

The engraving is formed only on the outer surface of the insulating cover 80 in the foregoing embodiment. However, the engraving may be formed only on an inner surface of the insulating cover or on both the outer and inner surfaces of the insulating cover, instead. When the engraving is formed on the inner surface of the insulating cover, a metal die for the cover 80 needs to be generally tapered so as to have such a draft that the molding is easily released from the die in the injection molding of the cover. Furthermore, when the engraving is formed on the inner surface of the insulating cover, the total light transmittance is rendered lower as compared with the case where the engraving is formed only on the outer surface of the insulating cover. Accordingly, the engraving may be formed on the inner surface of the insulating cover only when required on the inner surface of the insulating cover.

The insulating cover 80 contributes both to the measure against static electricity and to the measure against light ring in the foregoing embodiment. However, two discrete members may be provided for both measures respectively. The insulating cover 80 further serves as a holder for fixing the LED lamp 60 to the arm 16 and as a holder for fixing the LED lamp 60 to the substrate 66. Thus, the insulating cover 80 has four functions. Two discrete members may serve as the respective holders.

The attachment portion S to which the thread cassette 40 is attached is formed in the front of the left end of the arm 16 so as to be recessed rearward or inside the sewing machine 10 in the foregoing embodiment. Although there is little room in the interior of the arm 16, the size of the arm 16 can be reduced when the above-described LED lamps 60 are used. However, even when the present invention is applied to a sewing machine provided with no thread cassette, a sewing arm can be reduced in size and a space for an inner mechanism can be ensured.

The illuminating device 56 is disposed in the interior of the arm 16 in the rear of the attachment portion S of the thread cassette 40 in the foregoing embodiment. When a space is located below the attachment portion S, the illuminating device 56 may be disposed in the space, instead. Furthermore, space for accommodating the illuminating devices 56 and 58 is smaller than space for conventional electric lamp since each of the illuminating devices 56 and 58 is small in size. Accordingly, the two illuminating devices may be disposed even in a small space in the left end of the arm 16. Additionally, the illuminating devices 56 and 58 may be disposed so that the lens covers 82 protrude from the arm 16.

The frame 18 including the continuously formed bed 12, pillar 14 and arm 16 is divided into two parts in the foregoing embodiment. The frame 18 may be divided into three parts, instead. Particularly, the arm 16 may include two discrete parts, that is, a first part constituting the left side face and a second part. In this case, the sewing machine 10 is constructed so that the LED lamps 60 both in ON state are exposed when the first part is detached from the arm 16. Even when the LED lamps 60 are exposed, the LED lamps 60 and substrate 66 can be prevented from being broken since these components are covered with the insulating covers 80 or protected against discharge due to static electricity.

The illuminating devices 56 and 58 are located near the S/S button 42 in the foregoing embodiment. Accordingly, the user's hand or fingers easily tend to come close to the LED lamps 60. The LED lamps may be built in the S/S button 42 etc. In this case, the insulating cover 80 may constitute a part of the S/S button 42. For example, when a high brightness LED lamp is provided inside a portion of the S/S button 42 depressed by a finger for indicating an operating condition of the sewing machine 10, discharge due to static electricity and light ring may be prevented by the depressed portion itself. Furthermore, another member may be provided between the depressed portion and the LED lamp 60 for preventing discharge due to static electricity or light ring.

The lower shaft 24, lower mechanism 26, main shaft 36 and upper mechanism 38 are supported on the resin frame 18 in the foregoing embodiment (non-die-cast sewing machine). The resin and metal has thermal expansion coefficients differing from each other. Accordingly, the difference in the thermal expansion coefficients results in difference in amount of expansion or contraction due to temperature changes. As a result, positions of the components of the sewing machine 10 easily tend to be displaced from one another. However, displacement of the components due to temperature changes can be prevented in the sewing machine 10 in which the above-described LED lamps 60 are used. Additionally, the present invention may be applied to sewing machines in which sewing mechanisms are supported by means of metal die-casting.

A large number of reinforcing ribs 20*a* and 22*a* are provided inside the resin frame 18. Accordingly, an inner space of the sewing machine 10 is narrow. However, since the LED lamp 60 is sufficiently small, the size of the sewing machine 10 need not be increased for the purpose of accommodating the illuminating devices 56 and 58. Further, the upper mechanism 38 and the illuminating devices 56 and 58 can easily be disposed in the arm 16.

The supporting member 96 discrete from the arm 16 is fixed inside the arm in the foregoing embodiment. However, the supporting member 96 may be formed integrally with the arm 16, instead. Further, in a sewing machine employing the aforesaid die-casting, a part of the die-cast may constitute the supporting member 96. Additionally, a discrete member serving as the supporting member may be mounted to the die-casting.

The insulating cover 80 is provided for preventing adverse effects of discharge on the LED lamp 60 in the foregoing embodiment. The cover may be semiconducting or conductive when a larger space is defined between the LED lamp and the cover 80. Further, the cover 80 may be made from a transparent conductive resin. In this case, the cover 80 serves as a lightning rod or conductor which causes electric current to flow into the LED lamp 60 without discharge even when subjected to static electricity from the user's finger or hand.

A feed dog is provided for moving the cloth W in the sewing machine 10 in the foregoing embodiment. On the other hand, the user is also charged with static electricity when cloth is attached to an embroidery frame and moved with the frame. The present invention may be applied to an embroidering machine in which cloth is moved with an embroidery frame.

Although the screw 92 is metallic in the foregoing embodiment, the screw may be made from another material, for example, a resin.

The foregoing description and drawings are merely illustrative of the principles of the present invention and are not to be construed in a limiting sense. Various changes and modifications will become apparent to those of ordinary skill in the art. All such changes and modifications are seen to fall within the scope of the present invention as defined by the appended claims.

I claim:

1. A sewing machine, comprising;

a sewing bed on which cloth to be sewn is placed;

a pillar extending upward from the bed;

a sewing arm extending horizontally from the pillar so as to be located over the bed;

a high brightness LED lamp including a lens;

a lamp cover provided to cover and support the LED lamp and made from a material which can transmit light emitted by the LED lamp; and a supporting member provided on the arm for supporting the lamp cover further supporting the LED lamp.

2. A sewing machine according to claim 1, wherein the LED lamp is fabricated from a III–V compound semiconductor material in a periodic table.

3. A sewing machine according to claim 1, further comprising a light diffusing member for diffusing light emitted by the LED lamp over an illumination region.

4. A sewing machine according to claim 1, wherein the lamp cover diffuses the light emitted by the LED lamp in a plurality of directions intersecting each other.

5. A sewing machine according to claim 4, wherein the lamp cover has a surface including at least a part serving for light diffusion, said part being formed with an engraving which diffuses the light emitted by the LED lamp.

6. A sewing machine according to claim 5, wherein the surface of the lamp cover includes an outer surface only on which the engraving is formed.

7. A sewing machine according to claim 1, wherein the lamp cover includes a covering portion which covers the lens of the LED lamp and a mounting portion on which a substrate connected to the LED lamp is mounted.

8. A sewing machine according to claim 1, wherein the supporting member is made from a resin.

9. A sewing machine according to claim 1, wherein the arm includes an attachment portion to which a thread cassette serving as an upper thread source is attached.

10. A sewing machine according to claim 1, wherein the bed, pillar and arm are formed continuously into a resin frame and which further comprises a metal sewing mechanism mounted on the frame.

11. An illuminating device for a sewing machine which includes at least a sewing arm provided with a supporting member, the illuminating device comprising:

a high brightness LED lamp including a lens; and a lamp cover provided to cover and support the LED lamp and made of a material which can transmit light emitted by the LED lamp, the lamp cover being adapted to be supported by the supporting member.

12. An illuminating device for a sewing machine, comprising:

a high brightness LED lamp including a lens; and a lamp cover provided to cover and support the LED lamp and made of a material which can transmit light emitted by the LED lamp, the lamp cover diffusing light emitted by the LED lamp in a plurality of directions intersecting each other.

13. An illuminating device for a sewing machine according to claim 12, wherein the lamp cover has a surface including at least a part serving for light diffusion, said part being formed with an engraving which diffuses the light emitted by the LED lamp.

14. An illuminating device for a sewing machine according to claim 13, wherein the surfaces of the lamp cover includes an outer surface only on which the engraving is formed.

* * * * *